US010434398B1

(12) United States Patent
McCarthy et al.

(10) Patent No.: US 10,434,398 B1
(45) Date of Patent: Oct. 8, 2019

(54) REINFORCED CLIMBING SKINS

(71) Applicant: G3 Genuine Guide Gear Inc., Burnaby, BC (CA)

(72) Inventors: Edward McCarthy, North Vancouver (CA); Cameron Shute, Nelson (CA)

(73) Assignee: G3 Genuine Guide Gear Inc., Burnaby, BC (CA)

( * ) Notice: Subject to any disclaimer, the term of this patent is extended or adjusted under 35 U.S.C. 154(b) by 0 days.

(21) Appl. No.: 16/172,605

(22) Filed: Oct. 26, 2018

(51) Int. Cl.
*A63C 7/02* (2006.01)
*A63C 7/04* (2006.01)

(52) U.S. Cl.
CPC . *A63C 7/02* (2013.01); *A63C 7/04* (2013.01)

(58) Field of Classification Search
CPC ..... A63C 7/00; A63C 7/02; A63C 7/04
USPC ..... 280/604
See application file for complete search history.

(56) References Cited

U.S. PATENT DOCUMENTS 4,844,500 A * 7/1989 Fischer ..... A63C 5/044 280/604
6,471,234 B2 10/2002 Ayliffe
6,604,755 B2 8/2003 Ayliffe et al.
7,287,775 B2 10/2007 Walker et al.
8,061,731 B2 * 11/2011 Popenas ..... A63C 7/06 280/604
8,474,853 B2 7/2013 Rogers et al.
8,844,963 B2 9/2014 McCrank et al.
9,027,951 B2 5/2015 Holzer et al.
9,126,096 B2 9/2015 Puelacher
9,908,030 B2 3/2018 Shute et al.
2008/0185817 A1 8/2008 Gyr
2016/0045813 A1 2/2016 Mayrhofer et al.

FOREIGN PATENT DOCUMENTS

CA 2332217 C 4/2002
DE 9304437 U1 9/1994
DE 102007025280 A1 * 5/2008 ..... A63C 7/02

OTHER PUBLICATIONS

Romeo, Steve (randosteve), "Installing New Black Diamond Adjustable Skin-Tip Loops", Tetonat.com, http://www.tetonat.com/2009/08/17/installing-new-black-diamond-adjustable-skin-tip-loops/ (Published: Aug. 17, 2009) (Accessed: Jan. 24, 2019).

* cited by examiner

*Primary Examiner* — John D Walters
(74) *Attorney, Agent, or Firm* — Kolisch Hartwell, P.C.

(57) ABSTRACT

One aspect is an exemplary climbing skin extending along a longitudinal axis. For example, the skin may comprise: an attachment surface engageable with an undersurface of the snow device; a glide surface that slides across snow when moved in a forward direction along a longitudinal axis of the skin and resists sliding across the snow when moved in a rearward direction along the longitudinal axis; and a stiffener element disposed between the attachment surface and the glide surface to resist a lateral bending about the longitudinal axis and permit a longitudinal bending about a lateral axis of the skin that is generally perpendicular to the longitudinal axis.

20 Claims, 7 Drawing Sheets

REINFORCED CLIMBING SKINS

BACKGROUND

Field

Aspects of this disclosure relate to reinforced climbing skins for a snow device.

Description of Related Art

Climbing skins may be used in snow to assist in travelling forward along flat ground or when ascending a slope on a snow device, such as a ski or a separated half of a split snowboard. Each climbing skin may be attached to an undersurface of each snow device. Originally made from the skins of animals, modern climbing skins may comprise a fabric containing synthetic and/or natural fibers with a pile surface comprising a nap. The nap may be unidirectional. The fabric may be adhered to the undersurface of the snow device with the pile facing the snow and the nap angled rearwardly to permit forward movements and resist rearward movements, such as slipping partially backwards on a hill. Accordingly, through the use of climbing skins, a user may ascend a reasonably steep snow slope through use of a walking or shuffling motion.

A forward end of the climbing skin may be attached at or near a forward end of the snow device. Exemplary attachment means are described in U.S. Pat. No. 9,908,030, as a pair of clips. The climbing skin may comprise an adhesive engageable with an undersurface of the snow device. Various reusable adhesives are known in the art for this purpose. Such adhesives may remain sticky at low temperatures and permit repeated attachment and removal of a climbing skin from the undersurface of the snow device. Such climbing skins may be known as "glued climbing skins." As described in U.S. Pat. No. 9,027,951, it is desirable for a portion of the climbing skin underlying a forward curved portion of the snow device to be adhered as best as possible.

During use, snow can creep between the climbing skin and the undersurface of the snow device, potentially causing the skin to peel away from the snow device. This may occur at the forward end or the rearward end of the climbing skin.

SUMMARY

One aspect of the present disclosure is a climbing skin extending along a longitudinal axis. For example, the skin may comprise: an attachment surface engageable with an undersurface of a snow device; a glide surface that slides across snow when moved in forward directions along the longitudinal axis and resists sliding across the snow when moved in rearward directions along the longitudinal axis; and a stiffener element disposed between the attachment surface and the glide surface to resist a lateral bending about the longitudinal axis and permit a longitudinal bending about a lateral axis of the skin that is generally perpendicular to the longitudinal axis.

The stiffener element may comprise a first resistance to the lateral bending and a second resistance to the longitudinal bending. For example, the first resistance may be greater than the second resistance. The stiffener element may be disposed between an interior of the attachment surface and an interior of the glide surface. For example, the stiffener element may be bonded to one or both of the interior of the attachment surface and the interior of the glide surface.

The stiffener element may comprise an anisotropic material. For example, the anisotropic material may comprise elongated elements intersecting the longitudinal axis at an intersecting angle. The elongated elements may comprise one or more of a fiber, a strand, and a yarn; and/or the anisotropic material may comprise one or more of an adhesive, a fiber matrix, a knit, a laminate, and a weave configured to maintain the intersecting angle.

The stiffener element may comprise elongated elements intersecting the longitudinal axis at an intersecting angle. For example, the elongated elements may be bonded to or integral with one or both of the attachment surface and the glide surface to maintain the intersecting angle; and/or be spaced apart to permit the longitudinal bending. The stiffener element also may comprise a sheet of material. For example, the sheet of material may comprise: a thickness of approximately 0.25 mm to 5.0 mm; a material hardness range of approximately 80 Shore A to 90 Shore D; and a flexural modulus of approximately 200 MPa or less. As a further example, the sheet of material also may comprise: a thickness of approximately 0.075 mm to 1.0 mm; a material hardness range of approximately 60 Shore D to Rockwell R130; and a flexural modulus of approximately 3200 MPa or less.

The stiffener material may comprise a corrugated structure. For example, the corrugated structure may comprise a plurality of interconnected beam elements intersecting the longitudinal axis at an intersecting angle. The stiffener element may be bonded to one or both of the interior of the attachment surface and the interior of the glide surface by an adhesive. For example, the stiffener element may comprise one or more thickened portions of the adhesive intersecting the longitudinal axis at an intersecting angle. Any stiffener element described herein may comprise one or more of: an aramid; a carbon; a glass; a fiberglass; a polyolefin; a synthetic polymer; an ultra-high-molecular-weight polyethylene; an acetal resin; a nylon; a polyurethane; a thermoplastic polyurethane; and an aluminum shim.

Another aspect of the present disclosure is another climbing skin extending along a longitudinal axis. For example, the skin may comprise: an attachment surface engageable with an undersurface of the snow device; a glide surface that slides across snow when moved in a forward direction along a longitudinal axis of the skin and resists sliding across the snow when moved in a rearward direction along the longitudinal axis; and a stiffener element disposed between the attachment surface and the glide surface to resist a lateral bending about the longitudinal axis and permit a longitudinal bending about a lateral axis of the skin that is generally perpendicular to the longitudinal axis, the element extending in the rearward direction from a forward end of the skin along a reinforced length that is equal to or less than a total length of the skin.

The stiffener element may comprise any variation described above. For example, the stiffener element may be bonded to the interior of the attachment surface and the interior of the glide surface along the reinforced length. As a further example, the stiffener element may comprise one or more of an anisotropic material, an elongated element, a sheet of material, a corrugated structure, and an adhesive.

Yet another aspect of the present disclosure is yet another climbing skin extending along a longitudinal axis. For example, the skin may comprise: an attachment surface engageable with an undersurface of the snow device; a glide surface that slides across snow when moved in a forward direction along a longitudinal axis of the skin and resists sliding across the snow when moved in a rearward direction along the longitudinal axis; and a stiffener element bonded to an interior of the attachment surface and an interior of the glide surface by an adhesive operable with the stiffener element to provide a first resistance to a lateral bending about the longitudinal axis and a second resistance to a longitudinal bending about a lateral axis of the skin that is generally perpendicular to the longitudinal axis.

The stiffener element may comprise any variation described above. For example, the first resistance to the lateral bending may be greater than the second resistance to the longitudinal bending.

Additional methods, kits, and systems may be described with reference to the aspects described herein and/or inherent to those descriptions.

BRIEF DESCRIPTION OF THE DRAWINGS

The accompanying drawings, which are incorporated in and constitute part of this disclosure, illustrate exemplary aspects that, together with the written descriptions, serve to explain the principles of this disclosure. Numerous aspects are particularly described, pointed out, and taught in the written descriptions. Some structural and operational aspects may be even better understood by referencing the written portions together with the accompanying drawings, of which.

DETAILED DESCRIPTION

Aspects of the present disclosure are not limited to the exemplary structural details and component arrangements described in the written descriptions and depicted in the accompanying drawings. Many aspects of this disclosure may be applicable to other aspects and/or capable of being practiced or carried out in various variants of use, including those described herein.

Throughout the written descriptions, specific details are set forth in order to provide a more thorough understanding to persons of ordinary skill in the art. For convenience and ease of description, some well-known elements may be described conceptually to avoid unnecessarily obscuring the focus of this disclosure. In this regard, the written descriptions and accompanying drawings should be interpreted as illustrative rather than restrictive, enabling rather than limiting.

Aspects of this disclosure reference reinforced climbing skins. Some aspects are described with reference to particular surfaces and/or layers. Unless claimed, these exemplary aspects are provided for convenience and not intended to limit the present disclosure. Accordingly, the concepts described in this disclosure may be utilized for any type of climbing skin.

Figure 1:
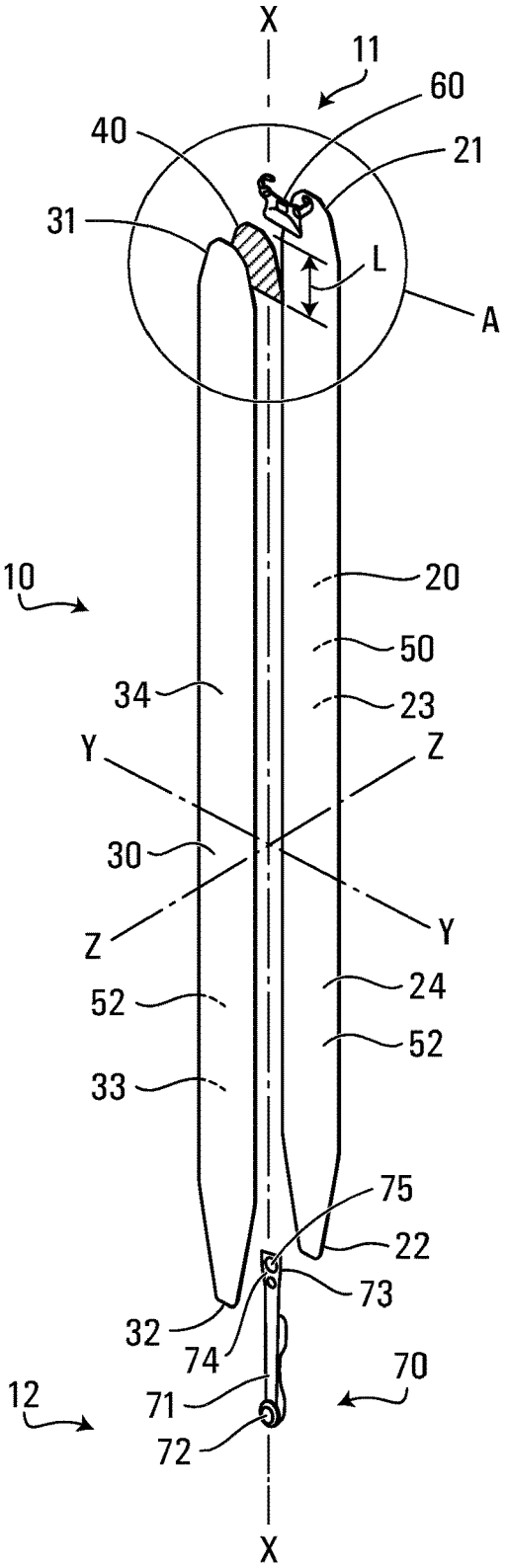
FIG. 1 depicts an exploded view of an exemplary climbing skin and an exemplary stiffener element, and indicates a local area A.

The present disclosure references three main axes, including: a longitudinal X-X axis, a lateral Y-Y axis, and a vertical axis Z-Z. Elements may be described with reference to any of these three main axes. As shown in FIG. 1, for example, axis X-X may intersect axes Y-Y and Z-Z at an origin point to define a Cartesian coordinate system; and some elements may described as having a length measured along axis X-X, a width measured along axis Y-Y, and a thickness measured along axis Z-Z. Additional axes, movements, and forces also may be described with reference to main axes X-X, Y-Y, and Z-Z. These terms are provided for convenience and do not limit this disclosure unless claimed.

As used herein, inclusive terms such as "comprises," "comprising," "includes," "including," and variations thereof, are intended to cover a non-exclusive inclusion, such that an apparatus or element thereof comprising a list of elements does not include only those elements, but may include other elements not expressly listed and/or inherent to the apparatus. Unless stated otherwise, the term "exemplary" is used in the sense of "example," rather than "ideal." Various terms of approximation may be used in this disclosure, including "approximately" and "generally." Approximately means within 10% of a stated number or outcome.

Exemplary aspects of are now described with reference to FIG. 1, which depicts a climbing skin 10 comprising a forward end 11 disposed opposite of a rearward end 12 along a longitudinal axis X-X. As shown in FIG. 1, forward end 11 may be shaped to match a corresponding forward end of a snow device, such as a ski or a snowboard half; and rearward end 12 may be shaped to match a corresponding rearward end of the snow device. For example, forward end 11 of FIG. 1 may comprise an elongated semi-circular shape tapering along longitudinal axis X-X to match a corresponding forward end 1 of a snow device 5 of FIG. 2; and rearward end 12 may comprise an elongated triangular shape tapering along axis X-X to match a corresponding rearward end 2 of snow device 5.

Figure 2:
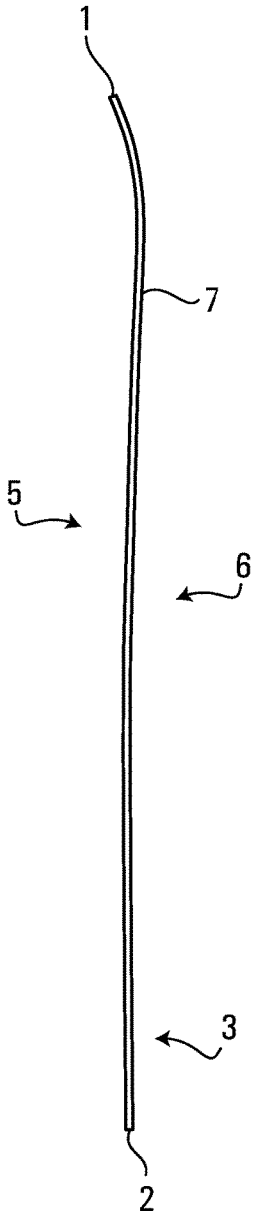
FIG. 2 depicts an exemplary snow device.

FIG. 2 depicts additional aspects of exemplary snow device 5 (e.g., a traditional ski in this instance). As shown, snow device 5 may extend between forward end 1 and rearward end 2; and forward end 1 may curve upward relative to an undersurface 7 of device 5. For example, snow device 5 of FIG. 2 may comprise a curved portion 3 at forward end 1 and a central portion 6 extending rearwardly therefrom. During use: forward end 11 of skin 10 may be attached to forward end 1 of snow device 5 by any attachment means; and rearward end 12 of skin 10 may be attached to rearward end 2 of snow device 5 by any attachment means. In this configuration, central portion 6 may be maintained against the snow by a weight of a user, and curved portion 3 may curve upwardly away from and out of the snow.

As described herein, climbing skin 10 of FIG. 1 may comprise: an attachment surface 20; a glide surface 30; a stiffener element 40; a forward clip 60; and a rearward clip 70. Examples of each element of skin 10 are now described.

Attachment surface 20 may comprise a flexible fabric containing any combination synthetic and/or natural fibers. As shown in FIG. 1, for example, attachment surface 20 may comprise: a forward end 21 disposed opposite of a rearward end 22 along longitudinal axis X-X; and a front or exterior 23 disposed opposite of a back or interior 24 along a vertical axis Z-Z. As part of forward end 11, forward end 21 may comprise an elongated semi-circular shape tapering along axis X-X.

Glide surface 30 may comprise the same or a different fabric. For example, glide surface 30 also may comprise: a flexible fabric containing any combination of synthetic and/or natural fibers; and a pile surface comprising a uni-directional nap. Glide surface 30 may be shaped to match attachment surface 20. For example, as shown in FIG. 1, glide surface 30 may similarly comprise: a forward end 31 disposed opposite of a rearward end 32 along longitudinal axis X-X; a front or interior 33 disposed opposite of a back or exterior 34 along vertical axis Z-Z; and an elongated semi-circular shape tapering along axis X-X.

Front 23 of attachment surface 20 of FIG. 1 may be engageable with undersurface 7 of snow device 5 of FIG. 2. For example, front 23 may comprise a reusable adhesive 50 that remains sticky at low temperatures, and permits repeated removal of front 23 from undersurface 7 and re-attachment of front 23 to undersurface 7. Reusable adhesive 50 may be applied to all or a portion of front 23. For example, adhesive 50 may be applied at least along a central length of climbing skin 10 of FIG. 1 that is approximately equal to or greater than a length of central portion 6 of snow device 5 of FIG. 2. As a further example, adhesive 50 may comprise an adhesive liquid applied to front 23, an adhesive sheet attached to front 23, and/or any equivalent means.

As shown in FIG. 1, back 24 of attachment surface 20 may be engageable with front 33 of glide surface 30 to locate stiffener element 40, forward clip 60, and rearward clip 70. For example, back 24 and front 33 may be adhered by a permanent adhesive 52 to: stiffener element 40 and forward clip 60 at forward ends 21 and 31 to define forward end 11; each other to define a central portion of skin 10; and rearward clip 70 at rearward ends 22 and 32 to define rearward end 12. In this example, permanent adhesive 52 may bond elements 20, 30, 40, 60, and 70 together as integral elements of climbing skin 10.

Back 34 of glide surface 30 may be configured to slide across snow when moved in a forward direction along axis X-X, and resist sliding across the snow when moved in a rearward direction along axis X-X. For example, the pile surface of surface 30 may face the snow with the nap predominantly angled in a rearward direction so that the snow device may be slid across the ground surface in the forward direction with relative ease, and yet resist sliding across the snow in the rearward direction.

Stiffener element 40 may be maintained at a fixed position and orientation between attachment surface 20 and glide surface 30 by permanent adhesive 52. As part of forward end 11, stiffener element 40 also may comprise an elongated semi-circular shape tapering along axis X-X. For example, as shown in FIG. 1, the shape of stiffener element 40 may comprise a reinforced length L extending in the rearward direction along axis X-X from forward end 11 toward rearward end 12.

Reinforced length L may be equal to or less than a total length of skin 10. In some aspects, reinforced length L may comprise a minimum length necessary to maximize the durability of forward end 11. For example, reinforced length L may be selected to develop a flexural and/or tensile strength of stiffener element 40, making the durability of forward end 11 proportionate thereto. Reinforced length L also may be based on curved portion 3 of snow device 5. For example, length L of stiffener element 40 of FIG. 1 may extend from forward end 11 to a point beyond curved portion 3 of snow device 5 of FIG. 2 when skin 10 is attached to device 5. In this example, reinforced length L may be longer than a minimum length required to bond forward clip 20 and stiffener element 40 to back 24 of attachment surface 20 and front 33 of glide surface 30. In keeping with these examples, reinforced length L of FIGS. 1 and 9 may be less than approximately 20% of the total length of climbing skin 10 between forward end 11 and rearward end 12, and/or equal to approximately 10% to 30% of the total length of skin 10.

As shown in FIG. 1, stiffener element 40 may disposed between attachment surface 20 and glide surface 30 to resist at least a lateral bending about longitudinal axis X-X. Element 40 also may permit at least a longitudinal bending about a lateral axis Y-Y of skin 10 that is generally perpendicular to longitudinal axis X-X. For example, stiffener element 40 may comprise a first resistance to the lateral bending about longitudinal axis X-X and a second resistance to the longitudinal bending about lateral axis Y-Y. Element 40 may be isotropic. For example, the first resistance to the lateral bending may be approximately equal to the second resistance to the longitudinal bending. Element 40 also may be anisotropic. For example, the first resistance to the lateral bending may be greater than the second resistance to the longitudinal bending. In this example, the first resistance may maintain at least edge portions of forward end 11 of climbing skin 10 against corresponding edge portions of undersurface 7 of snow device 5 during use, and the second resistance may allow forward end 11 to be rolled-up and/or folded-up with skin 10 when not in use.

Figure 3:
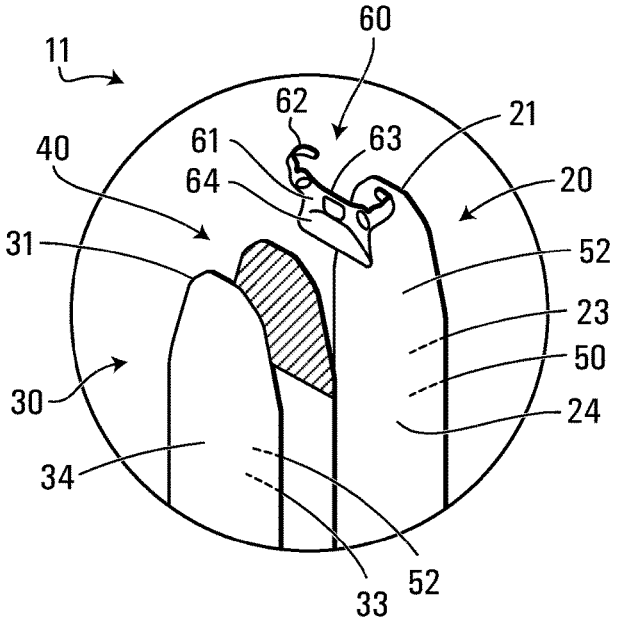
FIG. 3 depicts an enlarged view of the local area A of FIG. 1.

As shown in FIGS. 1 and 3, forward end clip 60 may comprise: a body 61; a pair of arms 62; a front attachment surface 63; and a back attachment surface 64. Pair of arms 62 may be attached to body 61 and engageable with forward end 1 of snow device 5. For example, arms 62 may be slid over forward end 1 into a secured position, and engageable with edge portions of end 1 to maintain the secured position. Front attachment surface 63 may be bonded to back 24 of attachment surface 20 with permanent adhesive 52; and back attachment surface 64 may be similarly bonded to stiffener element 40 with adhesive 52. As shown in FIG. 2, a portion of back attachment surface 64 may taper away from body 61 along axis X-X to accommodate the additional width of stiffener element 40.

As shown in FIG. 1, rearward end clip 70 may comprise a body 71; a connector 72; a front attachment surface 73; a back attachment surface 74; and one or more holes 75. Connector 72 may be attached to body 71 and engageable with rearward end 2 of snow device 5. For example, connector 72 may be clipped onto the rearward end and configured to apply a tensile force to climbing skin 10 that maintains arms 62 of forward clip 60 in the secured position. Front attachment surface 73 may be bonded to back 24 of attachment surface 20 with permanent adhesive 52; and back attachment surface 74 may be similarly bonded to front 33 of glide surface 30 with adhesive 52. As shown in FIG. 1, one or more holes 75 may extend through surfaces 73 and 74 to provide additional surface areas for adhesive 52 and/or permit insertion of additional securing means (e.g., screws).

As shown in FIGS. 1 and 3-8, stiffener element 40 may be disposed between back 24 of attachment surface 20 and front 33 of glide surface 30. For example, stiffener element 40 may be bonded to one or both of back 24 and front 33 by permanent adhesive 52. The configuration and disposition of stiffener element 40 may vary, and numerous additional and/or alternative examples are now described.

Figure 4:
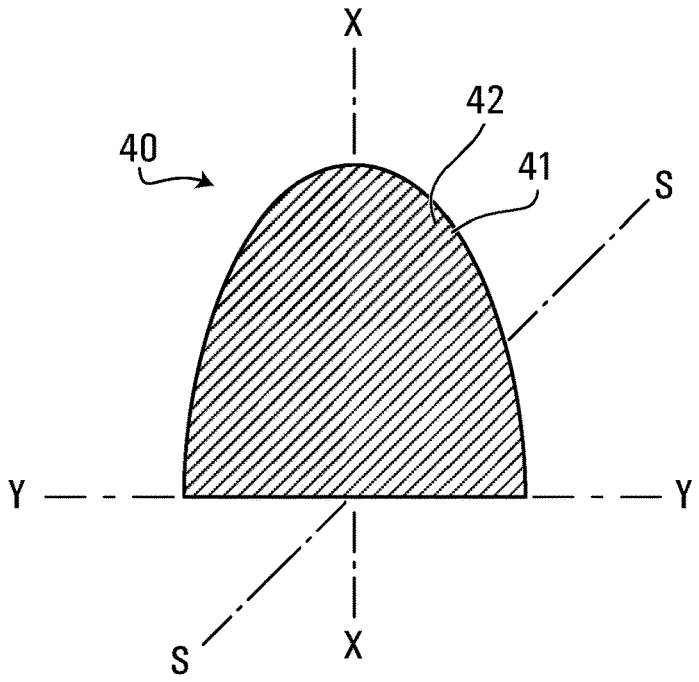
FIG. 4 depicts the exemplary stiffener element of FIG. 1.

As shown in FIG. 4, stiffener element 40 may comprise an anisotropic material 41 configured to resist the lateral bending about longitudinal axis X-X of climbing skin 10 and permit the longitudinal bending about lateral axis Y-Y. Anisotropic material 41 may enhance the durability of forward end 11 by resisting forces applied thereto. For example, anisotropic material 41 my modify flexural characteristics of forward end 11 of skin 10 (e.g., by increasing stiffness) in order to prevent gaps and/or snow build-up from forming between edge portions of attachment surface 20 of skin 10 and undersurface 7 of device 5.

As also shown in FIG. 4, anisotropic material 41 may comprise elongated elements 42 intersecting longitudinal axis X-X at an intersecting angle. Each elongated element 42 may comprise one or more of a fiber, a strand, and a yarn. For example, each elongated element 42 of FIG. 4 may extend along a stiffener axis S-S that intersects longitudinal axis X-X at the intersecting angle. Anisotropic material 41 may be configured to maintain the intersecting angle. For example, material 41 may comprise one or more of an adhesive, a fiber matrix, a knit, a laminate, and a weave that maintains the intersecting angle.

The intersecting angles descried herein may comprise any angle that is non-parallel with longitudinal axis X-X. As shown in FIG. 4, for example, the intersecting angle may be approximately 30 to 60 degrees. As similarly shown in FIG. 5 described further below, stiffener axis S-S also may be generally perpendicular with longitudinal axis X-X and/or generally parallel to lateral axis Y-Y, such that the intersecting angle is approximately 90 degrees.

Anisotropic material 41 may comprise any type of elongated elements 42 and/or other elongated elements joined by any means. For example, elongated elements 42 may comprise carbon fibers and anisotropic material 41 may comprise a carbon weave. As a further example, each element 42 may comprise: an aramid (aromatic polyamides, such as Kevlar®); a carbon; a glass; a fiberglass; a synthetic polymer (e.g., nylon); a polyolefin (e.g., highly oriented; 90+% polypropylene, such as Innegra S®); a polyurethane (e.g., a thermoplastic polyurethane); an ultra-high-molecular-weight polyethylene (or UHMWPE), such as Dyneema®; an aluminum shim; an acetal resin; and/or any equivalent compositions joined by any means.

Figure 5:
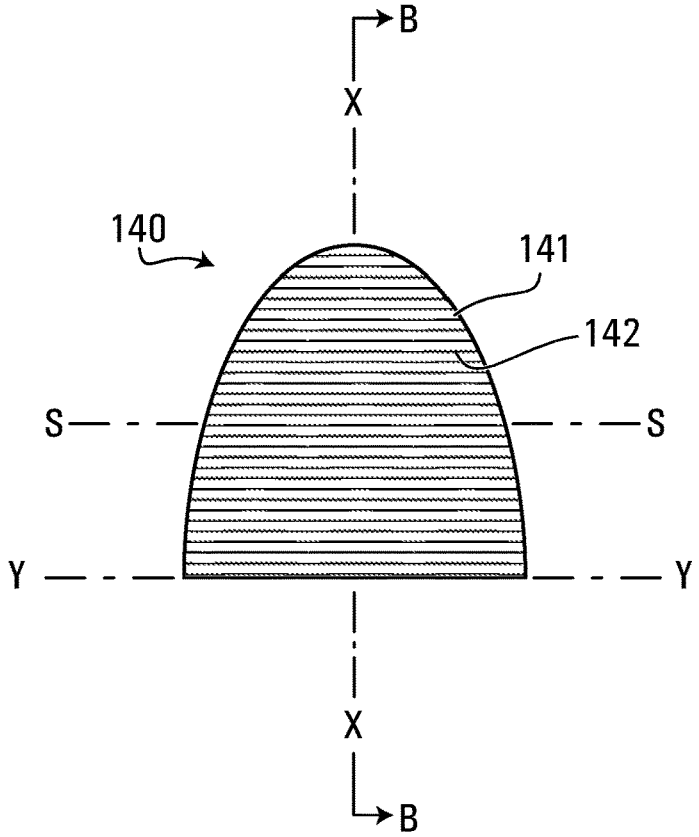
FIG. 5 depicts another exemplary stiffener element, and indicates a section line B-B.
Figure 6:
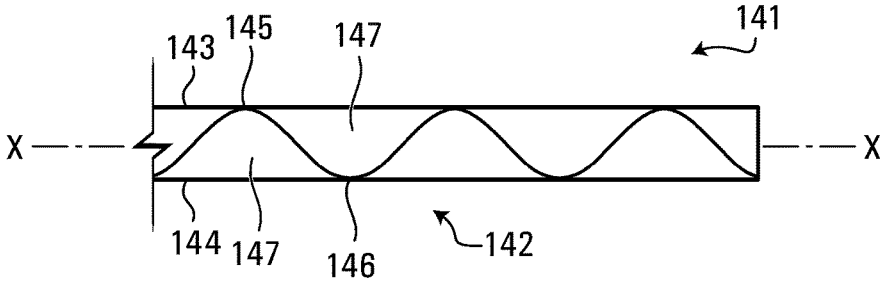
FIG. 6 depicts a cross-section of the stiffener element of FIG. 5 taken along section line B-B of FIG. 5.

As shown in FIGS. 5 and 6, another exemplary stiffener element 140 may comprise a corrugated structure 141 comprising a front 143, a back 144, and a plurality of stiffening elements 142 disposed therebetween. Any configuration of corrugated structure 141 and/or elements 142 may be used. For example, stiffening elements 142 of FIG. 6 may comprise a plurality of interconnected beam elements intersecting longitudinal axis X-X at an intersecting angle.

As shown in FIG. 6, the interconnected beam elements may be defined by: a series of ridges 145 and furrows 146 extending between faces 143 and 144. For example, a portion of front 143 may be attached to each ridge 145, a portion of back 144 may be attached to each furrow 146, front 143 may be bonded to back 24 of attachment surface 20 and/or forward clip 60, and back 144 may be bonded to front 33 of glide surface 30. In this example, the flexural characteristics of stiffener element 140 may be determined by the beam elements. For example, each ridge 145 and furrow 146 may intersect longitudinal axis X-X to resist the lateral bending; and interconnecting portions of structure 141 may flex away from axis X-X into void spaces 147 to permit the longitudinal bending.

Figure 7:
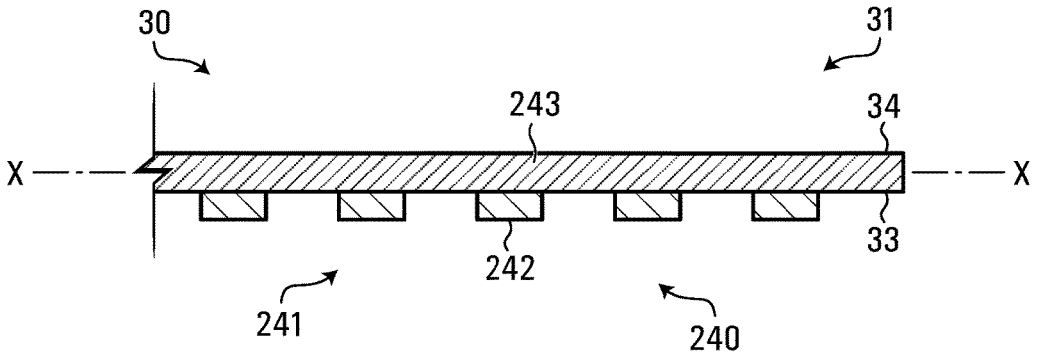
FIG. 7 depicts a cross-section of another exemplary climbing skin and stiffener element taken along a section line similar to section line B-B of FIG. 5.

Another exemplary stiffener element 240 is shown in FIG. 7 as comprising a built-up portion 241 of front 33 of surface 30. Built-up portion 241 may comprise a plurality of stiffening elements 242 intersecting the longitudinal axis at an intersecting angle (e.g., by extending along stiffener axis S-S of FIG. 4 or 5). Stiffening elements 242 may comprise any materials described above, including one or more elongated elements 42. As shown in FIG. 7, each stiffening element 242 may be formed with or bonded directly to front 33; and the bond may maintain the intersecting angle, allowing stiffening elements 242 to resist the lateral bending and permit the longitudinal bending. For example, each stiffening element 242 of FIG. 7 may comprise a rectangular cross-section extending along stiffener axis S-S of FIG. 4 or 5 to resist the lateral bending; and stiffening elements 242 may be spaced apart so that portions 243 of surface 30 between each element 242 may flex to permit the longitudinal bending. Surface 20 may be similarly modified.

Figure 8:
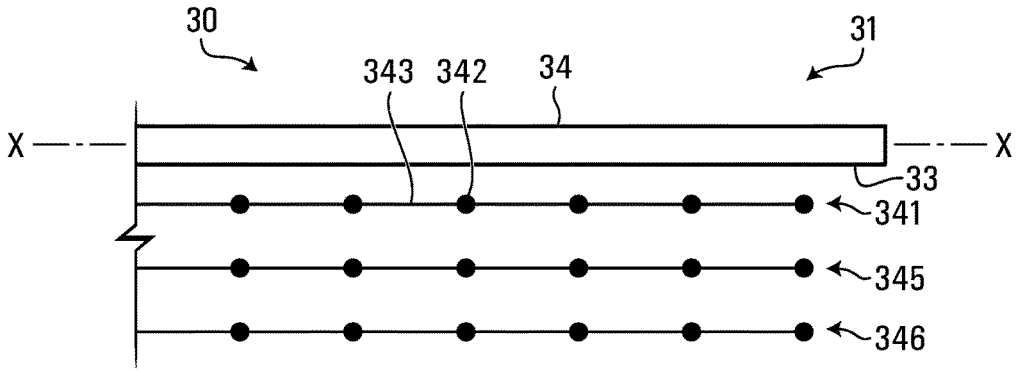
FIG. 8 depicts an exploded cross-section of another exemplary climbing skin and stiffener element taken along a section line similar to section line B-B of FIG. 5.

Still yet another exemplary stiffener element 340 is shown in FIG. 8, in which the stiffener element comprises a tape 341 being applied to front 33 of surface 30. As shown, tape 341 may comprise a plurality of stiffening elements 342 and an adhesive attachment surface 343. Stiffening elements 342 may be similar to stiffening elements 242. For example, each stiffening element 342 may be attached to or embedded along a length of tape 341 in a side-by-side or spaced apart configuration; and adhesive attachment surface 343 may be engageable with front 33 or back 24 to maintain an intersecting angle between elements 342 and longitudinal axis X-X, allowing elements 342 to resist the lateral bending about and permit the longitudinal bending. Several layers of tape 341 may be applied for additional reinforcement, as shown FIG. 8, which shows a second layer of tape 345 and a third layer of tape 346. Each layer of tape 341 may be compatible with permanent adhesive 52 (e.g., heat fuse-able therewith); and/or similarly applied to back 24 or another portion of skin 10.

Figure 9:
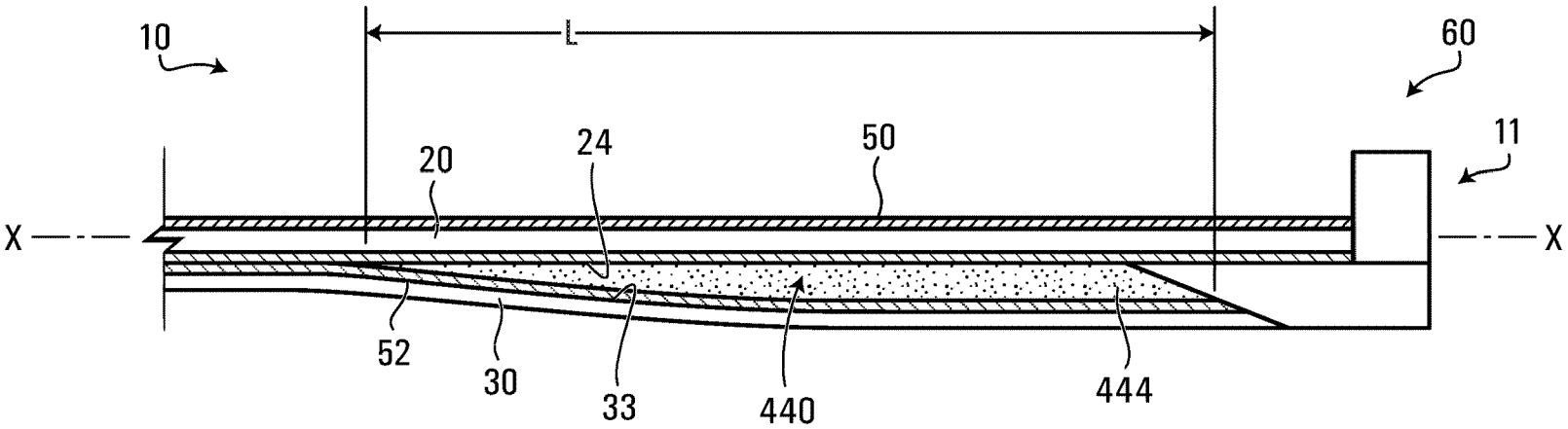
FIG. 9 depicts a cross-section of another exemplary climbing skin and stiffener element taken along a section line similar to section line B-B of FIG. 5.

Another exemplary stiffener element 440 is conceptually shown in FIG. 9, in which back 24 of attachment surface 20 is bonded to front 33 of glide surface 30 by permanent adhesive 52, and stiffener element 440 comprises a material 444. Various types of material 444 may be used. As shown, material 444 may comprise a layer of laminate or hot melt that is fused together with adhesive 52 along reinforced length L to create a stiffening layer disposed between back 24 and front 33. For example, material 444 may comprise one or more layers of a thermoplastic polyurethane that are built up to modify flexural characteristics of skin 10. Material 444 also may comprise additional applications or layers of permanent adhesive 52, resulting in a thickened portion of adhesive 52.

In some aspects (e.g., for thicker materials), material 444 may comprise a sheet of material with a thickness of approximately 0.25 mm to 5.0 mm, a material hardness range of approximately 80 Shore A to 90 Shore D, and a flexural modulus of approximately 200 MPa or less. In other aspects (e.g., for shim materials), material 44 may comprise a sheet of material with a thickness of approximately 0.075 mm to 1.0 mm, a material hardness range of approximately 60 Shore D to Rockwell R130, and a flexural modulus of approximately 3200 MPa or less.

Additional exemplary aspects are now described with reference to FIG. 10, which depicts another climbing skin 510 comprising a forward end 511 disposed opposite of a rearward end 512 along longitudinal axis X-X. As before, forward end 511 and rearward end 512 of FIG. 10 may be shaped to match corresponding forward and rearward ends 1 and 2 of snow device 5.

Figure 10:
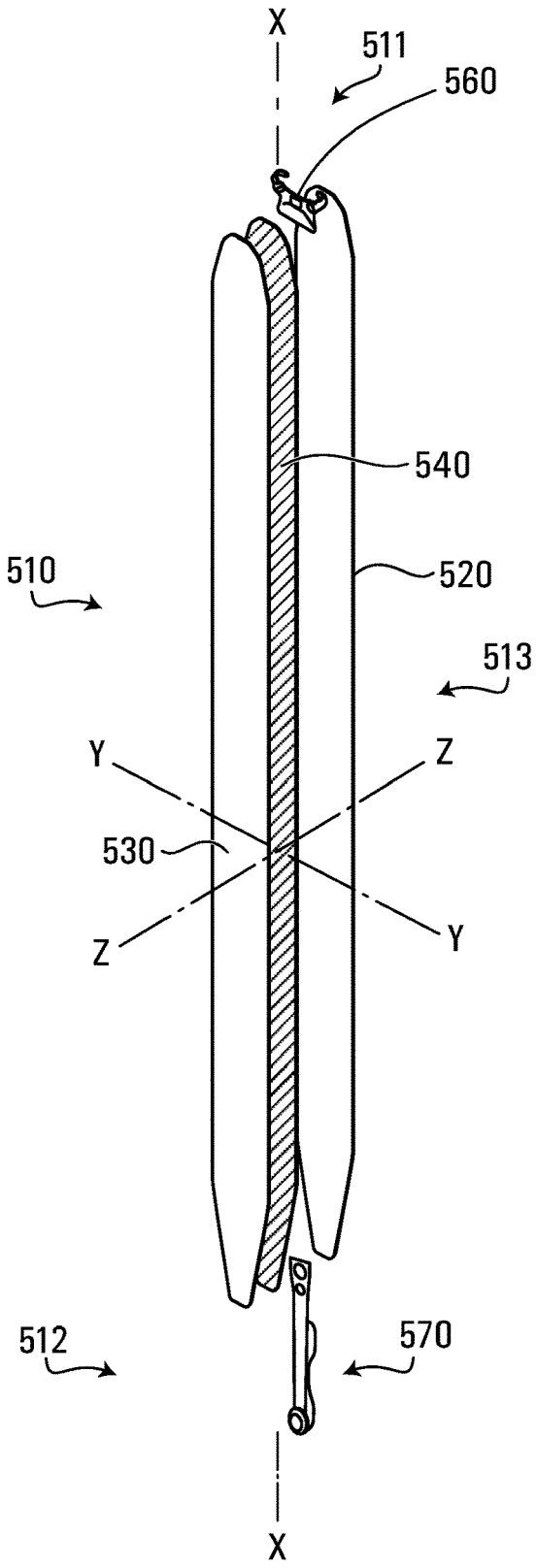
FIG. 10 depicts an exploded view of another exemplary climbing skin and another exemplary stiffener element.

Similar to above, climbing skin 510 of FIG. 10 may comprise: an attachment surface 520; a glide surface 530; a forward clip 560; and a rearward clip 570 similar to counterpart elements of skin 10, but within the 500 series of numbers. In contrast to above, skin 510 may comprise a stiffener element 540 extending a total length of skin 10 along longitudinal axis X-X between forward end 511 and rearward end 512. Aside from its extended length, stiffener element 540 may otherwise be similar to any stiffener element described herein and likewise configured to resist lateral bending and/or permit longitudinal bending.

As shown in FIG. 10, stiffener element 540 may reinforce forward end 511, rearward end 512, and a central portion 513 of climbing skin 510 extending therebetween. In some aspects, the flexural characteristics modified by stiffener element 540 may be used to prevent gaps and/or snow build-up from forming between attachment surface 520 and snow device 5 along the total length of skin 510. In other aspects, stiffener element 540 may increase the tensile strength of climbing skin 510, allowing clips 560 and 570 to be secured to the snow device with a correspondingly higher tensile force that further maintains central portion 513 of skin 510 against central portion 6 of snow device 5.

Figure 11:
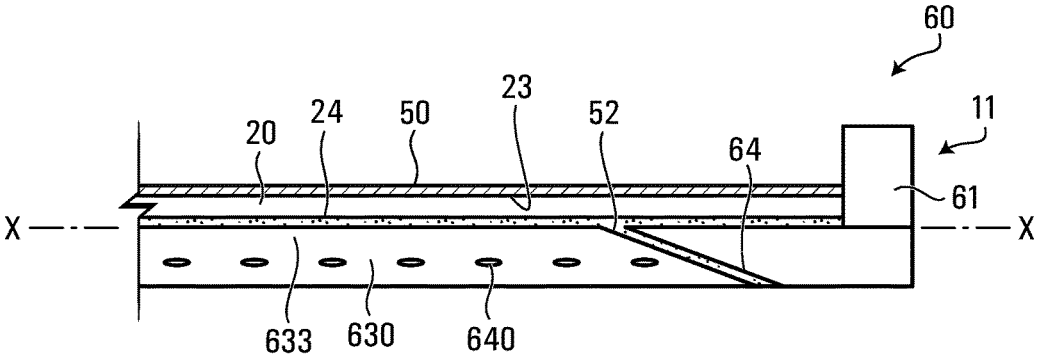
FIG. 11 depicts a cross-section of another exemplary climbing skin and stiffener element taken along a section line similar to section line B-B of FIG. 5.

Another exemplary stiffener element 640 may be integral with one or both of attachment surface 20 and glide surface 30. As shown in FIG. 11, for example, front 23 of attachment surface 20 may comprise reusable adhesive 50; and back 24 of attachment surface 20 may be bonded to a front 633 of a glide surface 630 by permanent adhesive 52; and stiffener element 640 may be integral with glide surface 630. In this example, stiffener element 640 may comprise elongated elements 642 that are suspended within glide surface 630. Similar to above, each elongated element 642 may intersect longitudinal axis X-X at an intersecting angle; and one or both of adhesive 52 and glide surface 630 may maintain the intersecting angle by preventing glide surface 630 from rotating relative to attachment surface 20. Glide surface 630 and elongated elements 642 of FIG. 11 may be similar to counterpart elements described above. For example, surface 630 may similarly comprise a weave, a fiber matrix, a knit, and/or a laminate; and elongated elements 642 may be suspended therein. Adhesive surface 20 may be similarly modified.

Figure 12:
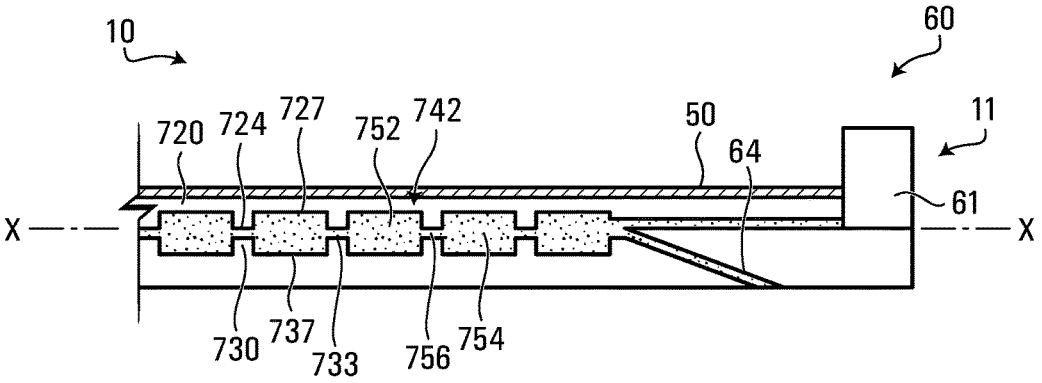
FIG. 12 depicts a cross-section of another exemplary climbing skin and stiffener element taken along a section line similar to section line B-B of FIG. 5.

Yet another exemplary stiffener element 740 is shown in FIG. 12 as being integral with one or both of attachment surface 20 and glide surface 30. As shown, attachment surface 720 may comprise a back 724 comprising grooves 727; glide surface 730 may comprise a front 733 comprising grooves 737; and grooves 727 may be disposed opposite of grooves 737 to define elongated cavities extending between surfaces 720 and 730 to intersect longitudinal axis X-X along an intersecting angle. Stiffener element 740 may comprise an elongated shape 742 located in the elongated cavities to modify flexural characteristics of skin 10. As shown in FIG. 12, front 733 may be bonded to back 724 by permanent adhesive 52, which may fill the elongated cavities so that each elongated shape 742 comprises a thickened portion 754 of adhesive 752. In this example, each thickened portion 754 may resist the lateral bending, and portions 756 of skin 10 between each portion 754 may permit the longitudinal bending. For additional flexural reinforcement, the material composition of adhesive 52 may be modified and/or another elongated element (e.g., any elongated element 42 described above) may be embedded in each elongated thickened portion 754.

While principles of the present disclosure are described herein with reference to illustrative aspects for particular applications, the disclosure is not limited thereto. Those having ordinary skill in the art and access to the teachings provided herein will recognize additional modifications, applications, aspects, and substitution of equivalents all fall in the scope of the aspects described herein. Accordingly, the present disclosure is not to be considered as limited by the foregoing description.

What is claimed:

1. A climbing skin for a snow device, the skin comprising:

an attachment surface engageable with an undersurface of the snow device;

a glide surface that slides across snow when moved in a forward direction along a longitudinal axis of the skin and resists sliding across the snow when moved in a rearward direction along the longitudinal axis; and a stiffener element disposed between the attachment surface and the glide surface to resist a lateral bending about the longitudinal axis and permit a longitudinal bending about a lateral axis of the skin that is generally perpendicular to the longitudinal axis.

2. The skin of claim 1, wherein the stiffener element comprises a first resistance to the lateral bending and a second resistance to the longitudinal bending, and the first resistance is greater than the second resistance.

3. The skin of claim 1, wherein the stiffener element is disposed between an interior of the attachment surface and an interior of the glide surface.

4. The skin of claim 3, wherein the stiffener element is bonded to one or both of the interior of the attachment surface and the interior of the glide surface.

5. The skin of claim 1, wherein the stiffener element comprises an anisotropic material.

6. The skin of claim 5, wherein the anisotropic material comprises elongated elements intersecting the longitudinal axis at an intersecting angle.

7. The skin of claim 6, wherein the elongated elements comprise one or more of a fiber, a strand, and a yarn.

8. The skin of claim 7, wherein the anisotropic material comprises one or more of an adhesive, a fiber matrix, a knit, a laminate, a tape, and a weave configured to maintain the intersecting angle.

9. The skin of claim 1, wherein the stiffener element comprises elongated elements intersecting the longitudinal axis at an intersecting angle, and the elongated elements are bonded to or integral with one or both of the attachment surface and the glide surface to maintain the intersecting angle.

10. The skin of claim 1, wherein the elongated elements are spaced apart to permit the longitudinal bending.

11. The skin of claim 1, wherein the stiffener element comprises a sheet of material comprising: a thickness of approximately 0.25 mm to 5.0 mm; a material hardness range of approximately 80 Shore A to 90 Shore D; and a flexural modulus of approximately 200 MPa or less.

12. The skin of claim 1, wherein the stiffener element comprises a sheet of material comprising: a thickness of approximately 0.075 mm to 1.0 mm; a material hardness range of approximately 60 Shore D to Rockwell R130; and a flexural modulus of approximately 3200 MPa or less.

13. The skin of claim 1, wherein the stiffener element comprises a corrugated structure comprising a plurality of interconnected beam elements intersecting the longitudinal axis at an intersecting angle.

14. The skin of claim 1, wherein the stiffener element is bonded to one or both of the interior of the attachment surface and the interior of the glide surface by an adhesive, and the stiffener element comprises one or more thickened portions of the adhesive intersecting the longitudinal axis at an intersecting angle.

15. The skin of claim 1, wherein the stiffener element comprises one or more of: an aramid; a carbon; a glass; a fiberglass; a polyolefin; a synthetic polymer; an ultra-high-molecular-weight polyethylene; an acetal resin; a nylon; a polyurethane; a thermoplastic polyurethane; and an aluminum shim.

16. A climbing skin for a snow device, the skin comprising:

an attachment surface engageable with an undersurface of the snow device;

a glide surface that slides across snow when moved in a forward direction along a longitudinal axis of the skin and resists sliding across the snow when moved in a rearward direction along the longitudinal axis; and a stiffener element disposed between the attachment surface and the glide surface to resist a lateral bending about the longitudinal axis and permit a longitudinal bending about a lateral axis of the skin that is generally perpendicular to the longitudinal axis, the element extending in the rearward direction from a forward end of the skin along a reinforced length that is equal to or less than a total length of the skin.

17. The skin of claim 16, wherein the stiffener element is bonded to an interior of the attachment surface and an interior of the glide surface along the reinforced length.

18. The skin of claim 16, wherein the stiffener element comprises one or more of an anisotropic material, elongated elements, a sheet of material, a corrugated structure, and an adhesive.

19. A climbing skin for a snow device, the skin comprising:

an attachment surface engageable with an undersurface of the snow device;

a glide surface that slides across snow when moved in a forward direction along a longitudinal axis of the skin and resists sliding across the snow when moved in a rearward direction along the longitudinal axis; and a stiffener element bonded to an interior of the attachment surface and an interior of the glide surface by an adhesive operable with the stiffener element to provide a first resistance to a lateral bending about the longitudinal axis and a second resistance to a longitudinal bending about a lateral axis of the skin that is generally perpendicular to the longitudinal axis.

20. The skin of claim 19, wherein the first resistance to the lateral bending is greater than the second resistance to the longitudinal bending.

* * * * *